United States Patent [19]

Dits

[11] 4,152,921

[45] May 8, 1979

[54] METHOD AND APPARATUS FOR THE SHOCK PRESSURE SHAPING

[75] Inventor: Herbert R. Dits, Schmelz, Fed. Rep. of Germany

[73] Assignee: Transform Verstarkungsmaschinen Aktiengesellschaft, Bous, Fed. Rep. of Germany

[21] Appl. No.: 800,072

[22] Filed: May 24, 1977

[30] Foreign Application Priority Data

May 25, 1976 [DE] Fed. Rep. of Germany ..... 2623428

[51] Int. Cl.[2] ..... B21J 9/12

[52] U.S. Cl. ..... 72/441; 72/453.02

[58] Field of Search ..... 72/453.02, 453.01, 453.18, 72/453.08, 441; 100/269 B

[56] References Cited

U.S. PATENT DOCUMENTS

| | | | |
|---|---|---|---|
| 1,068,243 | 7/1913 | Iversen | 100/269 B |
| 1,230,486 | 6/1917 | Jacomini | 100/269 B |
| 1,230,492 | 6/1917 | Kristufek | 100/269 B |
| 2,403,912 | 7/1946 | Doll | 100/269 B |
| 3,863,488 | 2/1975 | Deordiev | 72/453.18 |

FOREIGN PATENT DOCUMENTS

| | | | |
|---|---|---|---|
| 2290970 | 11/1974 | France | 72/453.02 |

*Primary Examiner*—C. W. Lanham
*Assistant Examiner*—Gene P. Crosby
*Attorney, Agent, or Firm*—Cushman, Darby & Cushman

[57] ABSTRACT

An impact shaping apparatus is provided having a hydraulic actuator associated to the shaping tool. A gas spring of adjustable spring constant is in permanent fluid connection with the hydraulic actuator so as to allow for adjustment of the impact characteristics in accordance with the cold-working characteristics of the material to be shaped. The gas spring is formed by a cylinder and a floating piston arranged therein and defining a first working space communicating with the hydraulic actuator and a second working space containing a mass of gas.

4 Claims, 3 Drawing Figures

METHOD AND APPARATUS FOR THE SHOCK PRESSURE SHAPING

A method for the shock pressure shaping of blanks to form finished products by using a shock pressure shaping tool, wherein the upper portion of the tool is placed upon the blank by hydraulic means under a tool closing pressure, upon having travelled through a tool closing stroke or path, to thereby hold down the blank until the shock pressure shaping process is initiated and to an apparatus for carrying out such method, which apparatus comprises one or more hydraulic or pneumatichydraulic energy sources, one or more liquid/gas accumulators adapted to be charged or pressurized, a hydraulic tool closing device and a hydraulic power cylinder.

It is known to produce finished parts with precise dimensions of outline and exact three-dimensional shape, particularly in the case of relatively small dimensions of the workpiece, by subjecting the blanks to impact shaping or forging under the action of drop hammers and thereby subjecting such blanks to cold working. In this operation, the kinetic energy of drop is instantaneously converted into energy of deformation, this taking place with relatively low efficiency, however. Due to the rapid conversion of energy, the force action providing a high degree of compression is confined to the surface zones, while the depth effect is much lower. Accordingly, this method is advantageous for smaller workpieces having sharp, well-defined protrusions of a high degree of precision.

A disadvantage of drop hammers of this type resides primarily in the great amount of noise produced thereby, which noise by far exceeds the permissible noise level limit of 75 dB according to the Safety Standards; therefore, the use of drop hammers of this type, without expensive noise guard casings, is prohibited in many countries.

On the other hand, hydraulic press devices, particularly for forging work, are known which are characterized in that the press main cylinder is connected to a pressurized fluid system designed only as a closing and preshaping system, and that the press main cylinder has associated therewith an auxiliary high-pressure generator apparatus including trigger means, as well as a valve protecting the pressurized fluid system.

Although this conventional apparatus permits high rates of deformation or shaping with the level of the pressure force being controllable in well-known manner by regulating the pressure of the operating medium, apparatuses of this type, same as drop hammers, suffer from the drawback that in physical respects these apparatuses provide an impact effect the characteristic of which falls between the purely inelastic and the purely elastic impacts, respectively. This characteristic which depends on the material, the tool and the pressure force produced, cannot be controlled as desired in the conventional apparatus. This fact is of secondary importance in hot working, but it may be ascribed a substantial significance in cold working operations, particularly in combinations of bending and embossing operations or in cold press forming operations, because, as experience has shown, it is both the deformability (plasticity) of the material and the quality of the surface profile of the workpiece that are related to the degree of elasticity of the impact effect.

It is the object of the present invention to improve the shaping of the material and the quality of the surface profile of the workpiece by selectively controlling the degree of elasticity of the deforming or shaping shock action.

According to the present invention, this is obtained in that the level of the tool closing pressure is adapted to be controlled, and that during the subsequent shock pressure shaping operation, the shaping or deforming process is influenced through a variable degree of elasticity of the shock pressure force by means of a pneumatic-hydraulic auxiliary pressure unit which functions as a gas spring.

For carrying out this method, according to the invention there is provided an auxiliary pressure unit in the form of a confined space, including a volume of gas compressed by the hydraulic liquid of the tool closing device, and wherein the liquid space of the auxiliary pressure unit is constantly in hydraulic communication with the space or volume containing the operating or power liquid of the power cylinder both during the tool closing cycle and the shock pressure shaping cycle but also during the switch-over period of the valve.

Preferably, the confined space of the auxiliary pressure unit is formed as a hydraulic cylinder having a floating piston acting to separate the hydraulic liquid from the gas volume, whereby the gas volume of the compression chamber is adapted to be reduced until the so-called "dead-space" is reached, e.g. by a piston being axially movable relative to the floating piston. In the present instance, by "dead-space" (clearance) a constructional provision in the form of an abutment or the like is meant, up to which the gas volume may be reduced without causing structural damage.

The method according to the invention and the apparatus for carrying out such method in constructionally and operationally most simple manner allow to provide a precisely adjustable or controllable holding pressure to be applied upon the workpiece blank following the tool closing operation, which holding pressure, in particular, also continuously spans the moment of transition from the tool closing system proper to the shaping or deforming system. At the same time, however, the auxiliary pressure unit according to the invention permits influence or control primarily of the degree of elasticity of the shock pressure shaping effect, particularly at the most important moment at the beginning of such deformation; this means that such degree of elasticity may be conformed to the specific deformability of the material, whereby the quality of the surface profiling of the material may be controlled as well.

Furthermore, the invention allows a still greater reduction of the noise level because of structural simplification, namely an uncomplicated construction.

Below, the present invention is explained in greater detail in a number of embodiments thereof, by referring the accompanying drawings, wherein.

Figure 1:
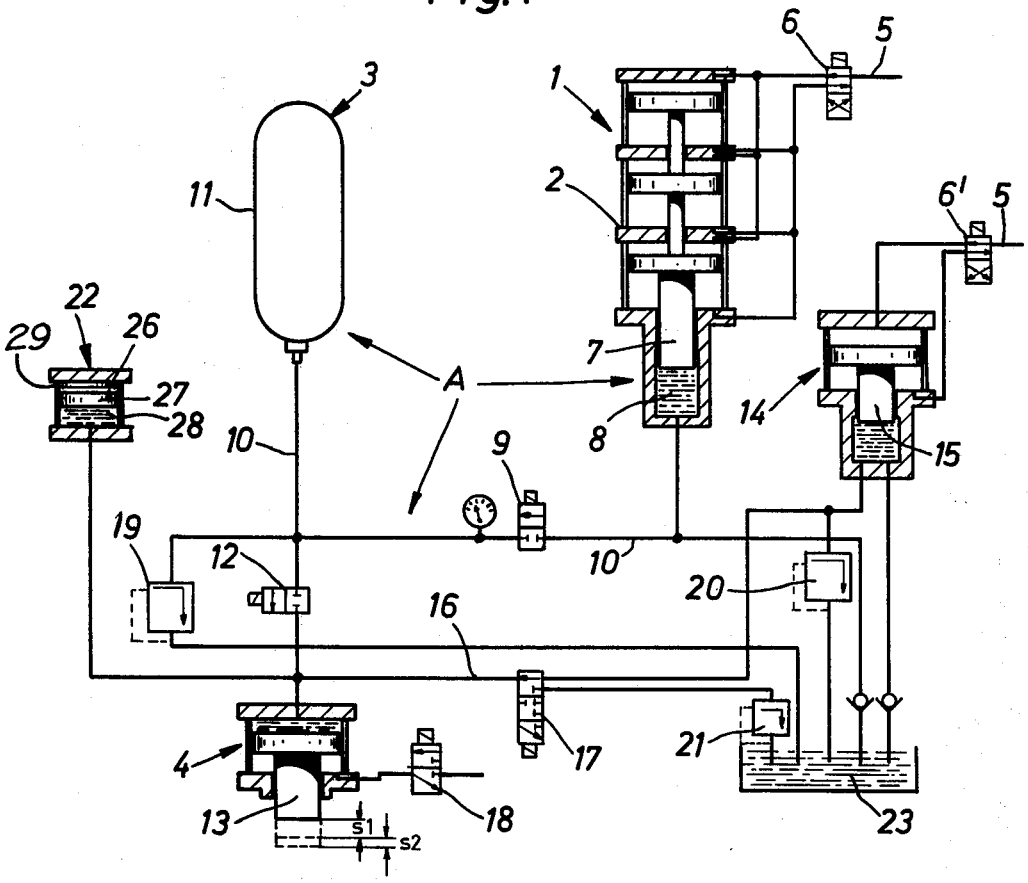
FIG. 1 is a schematical view of a specific embodiment of the shock pressing apparatus according to the present invention, partly shown in longitudinal section.

The shock pressing apparatus as illustrated in FIG. 1 comprises a pneumatic-hydraulic drive unit 1 which may include a hydraulic driving cylinder device 2 containing, for example, a plurality of pistons, a gas or energy accumulator 3 and a hydraulic power cylinder 4, these components in combination forming the working or power apparatus A proper, by which the cold working (cold forming) is effected. The driving cylinder device 2 operates as a hydropneumatic power converter which is supplied with pneumatic energy or power through a supply line 5 via a supply switch valve 6 (4/2-way valve), which pneumatic energy is applied to one side of the driving pistons and converted into hydraulic energy or power by said pistons and a plunger (floating piston) 7. The hydraulic liquid thus boosted to increased pressure energy within a plunger-type cylinder 8 is urged through a feed valve 9 (2/2-way valve) and a pressure conduit 10 into the bottom side of a pneumatic pressure accumultor 11 or compressed gas spring, e.g. in the form of a blast-pressure tank, to be stored therein at high pressure. An increase of the filling pressure to non-permissible values is prevented by a pressure relief valve 19.

The gas accumulator 11 adapted to be charged (pressurized) by the driving cylinder device 2 has its hydraulic-side end connected through a power valve 12 (2/2-way valve) to the hydraulic power cylinder 4 having a power ram 13 provided in its power output end, which ram is connected to a not illustrated shaping or forming tool.

A further pneumatic-hydraulic pressure converter is provided as a quick-response hydraulic tool closing device 14 operating independently of the travel of the shock pressure shaping operation and being fed with pneumatic power through a feed valve 6 (4/2-way valve) and the same feed line 5. The tool closing plunger 15 operative at the hydraulic-side end of this tool closing device is likewise connected to the hydraulic power cylinder 4 through a pressure conduit 16 and a 3/3-way tool closing valve 17, with the power cylinder additionally being provided with a 3/2-way return valve 18 by means of which (pressurized) air, but preferably pressurized oil may be applied to the lower face of the power piston in order to return the power piston including its ram 13 into the original position.

Another pressure relief valve 20 is provided for adjusting or controlling the pressure of the liquid used for closing the tool or die. Such tool closing pressure is substantially lower than the working or power oil pressure (e.g. 20 atmospheres as compared to 300 atmospheres).

Furthermore, the hydraulic power side of the power cylinder 4 has connected thereto an auxiliary pressure unit 22 in the form of a hydraulic cylinder defining a confined space, said cylinder including a floating piston or plunger 27 between the hydraulic liquid 28 and a gas volume 26 and being supplied with pressure by said tool closing device 14, and which upon rendering inoperative the tool closing device during transition to the shock pressure shaping operation effected by the gas accumulator 11, provides for maintaining of the tool closing pressure applied to the hydraulic power cylinder 4. During the tool closing operation when the power valve 12 is closed and the tool closing valve 17 is open, the gas is compressed within the auxiliary pressure unit 22. At full compression of the gas volume, the floating piston seats against optionally adjustable abutment sleeve 29 so as to avoid damage to the auxiliary pressure unit. The auxiliary pressure unit 22 by the compression pressure thereof acts on the subsequently performed shock pressure shaping operation to thereby influence or control the degree of elasticity thereof the auxillary pressure unit 22 therefore operates as a gas spring, the stiffness or spring constant of which is established and adjusted in accordance with the amount of pressurized fluid supplied from the tool closing device 14.

The power of energy accumulator 3 and the gas (pressure) accumulator 11 are hydraulically pressurized by the power cylinder device. Upon placing a blank into the shaping tool or die (not shown) below the power ram 13, such ram 13 is first placed upon the surface of the blank under the — relatively low — pressure provided by the tool closing device 14 through a closing stroke S1, this taking place under the control of the tool closing valve 17. This operation takes place very quickly and without excessive noise. Thereupon, the power valve 12 is opened automatically such that the accumulated shock pressure energy is allowed to act upon the blank with a short impulse, i.e. through a shock pressure shaping stroke S2. A number of shock pressure shaping cycles of this kind (e.g. 2 or 3 cycles) may be obtained with one full charge of the accumulator. Upon termination of the shaping or deforming process, and with the power valve 12 being inoperative, the piston and the ram 13 of the power cylinder 4 are returned into the initial position of the tool closing stroke by the return valve 18, this being required to some degree in order to allow handling of the blank and of the finished product below the tool.

A constant oil supply is provided by an oil reservoir 23 connected to the system.

Figure 2:
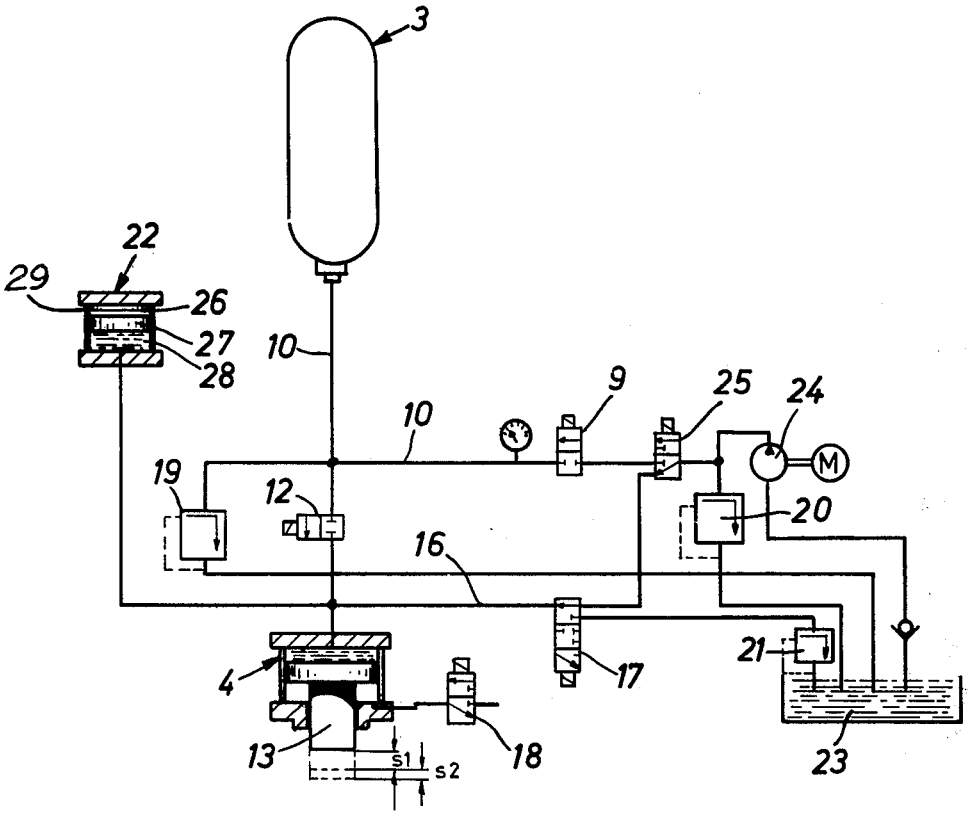
FIG. 2 is a schematical view of an alternative embodiment of the present shock pressing apparatus, partly shown in longitudinal section.
Figure 3:
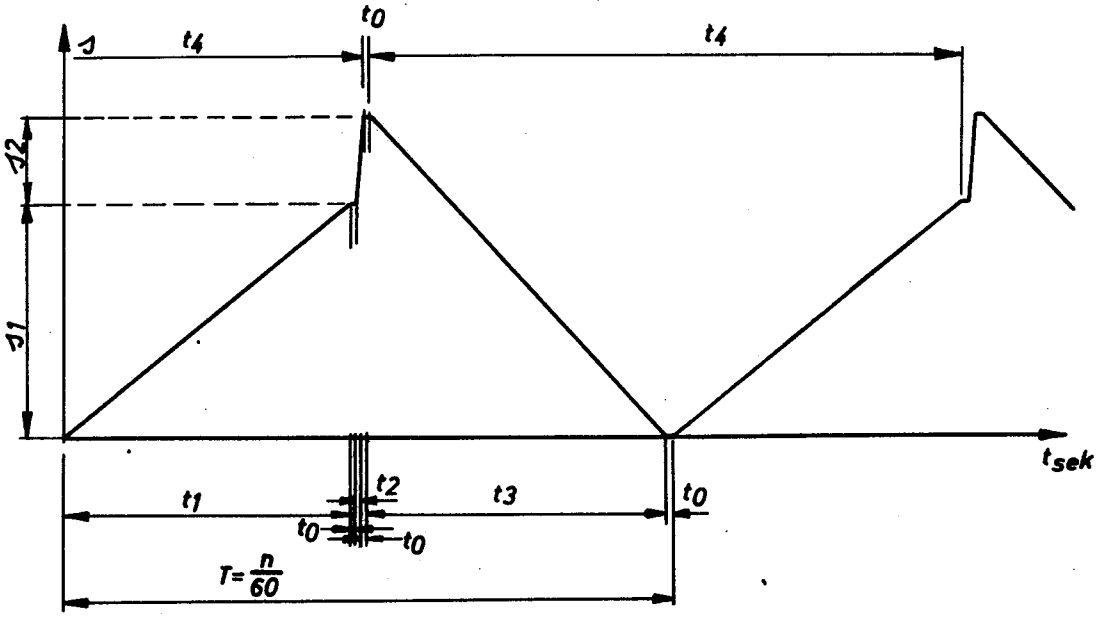
FIG. 3 shows a simplified length time diagram for a cycle of operation of the shock pressing apparatus according to the invention.

The embodiment according to FIG. 2 is substantially similar to the embodiment described above; however in this modified embodiment the pneumatic driving and tool closing pressures are provided by an oil pump 24, whereas a second reversing valve 25 serves to effect reversal between the charging and tool closing cycles.

The mode of operation illustrated in a simplified form in the length time diagram of FIG. 1 for one cycle of operation involves the following time sequence:

T: Total time of one cycle; with n strokes per minute in $T=n/60$;

$t_1$: Tool closing period required for the closing stroke S1;

$t_2$: Period of shaping or deformation required for the shaping stroke S2;

$t_3$: Period of returning the power ram through the total stroke of $H=S_1+S_2$;

$t_0$: Switch-over periods;

$t_4$: Period of time available for charging (pressurizing) the accumulator 3.

What we claim is:

1. An apparatus for impact shaping of workpieces comprising:

high pressure storage means for storing an hydraulic fluid;

a first control valve means;

hydraulic ram means connectable to said high pressure storage means by said first control valve means, and adapted for mounting a shaping tool;

a second control valve means;

second hydraulic pressure supply means connectable to said hydraulic ram means via said second control valve means; and a gas spring of adjustable spring constant connected in permanent fluid communication with the hydraulic ram means to permit adjustment of the impact characteristics of the apparatus.

2. The apparatus as in claim 1, further including pressure regulating means provided in the fluid line extending from said second hydraulic pressure supply means to the second control valve means.

3. The apparatus as in claim 1, wherein said gas spring includes a cylinder and a floating piston arranged therein to define a first variable working space communicating with said hydraulic ram means for receiving hydraulic fluid as well as a second variable working space containing a volume of gas.

4. The apparatus as in claim 3, including abutment means for limiting the retracting stroke of the floating piston and defining a minimum gas volume of the gas spring.

* * * * *